United States Patent [19]

Schalle

[11] Patent Number: 5,018,748

[45] Date of Patent: May 28, 1991

[54] SEAL DEVICE

[75] Inventor: Werner E. Schalle, Upper Beconsfield, Australia

[73] Assignee: Aquarius Rubber (AUST.) Pty. Ltd., Victoria, Australia

[21] Appl. No.: 357,558

[22] Filed: May 26, 1989

[30] Foreign Application Priority Data

May 27, 1988 [AU] Australia ..... PI8477

[51] Int. Cl.[5] ..... F16J 15/02

[52] U.S. Cl. ..... 277/012; 052/060; 052/199; 277/212 FB; 285/043

[58] Field of Search ..... 277/12, 178, 181, 182, 277/183, 184, 212 FB; 52/19, 20, 58, 60, 199, 219; 285/3, 4, 42, 43, 44

[56] References Cited

U.S. PATENT DOCUMENTS

| | | | |
|---|---|---|---|
| 3,098,663 | 7/1963 | Dibley | 285/43 |
| 4,160,347 | 7/1979 | Logsdon | 285/42 X |
| 4,280,305 | 7/1981 | Logsdon | 285/43 X |
| 4,333,660 | 6/1982 | Cupit | 285/42 X |
| 4,570,943 | 2/1986 | Houseman et al. | 277/12 |
| 4,742,797 | 5/1988 | Barker | 277/184 X |

FOREIGN PATENT DOCUMENTS

| | | | |
|---|---|---|---|
| 562520 | 8/1958 | Canada | 277/182 |

*Primary Examiner*—Thomas B. Will
*Assistant Examiner*—Scott Cummings
*Attorney, Agent, or Firm*—Browdy & Neimark

[57] ABSTRACT

A seal device for sealing between a surface such as a roof and an elongate member such as a pipe projecting through that surface. A one-piece mounting plate has a planar base portion with an access aperture therethrough, and is composed of metallic, non-resilient, manually deformable material. The base portion is located in a face-to-face relation with a mounting surface so that an elongate member projects through the access aperture. The base portion is deformable to conform to the contour of the surface and retain the deformed contour. A rim portion, which is integral with the base portion, extends about the periphery of the access aperture and upstands from the body portion, and that rim portion has a retaining lip spaced outwardly of the base portion and shaped to provide an underlying shoulder. A sealing member overlies the access aperture and has an access passage for receiving the elongate member therein with the sealing member sealingly engaging the elongate member. The sealing member also has a resiliently flexible skirt portion for overlying the rim portion with at least one retaining projection extending beneath the retaining lip for sealingly engaging against the rim portion and thereby releasably connecting the sealing member to the mounting plate. By resiliently distorting the skirt portion, the retaining projection can be fitted beneath and released from beneath the retaining lip to, respectively, connect and disconnect the sealing member and the one-piece mounting plate.

10 Claims, 2 Drawing Sheets

SEAL DEVICE

BACKGROUND OF THE INVENTION

1. Field of the Invention

This invention relates to a seal device for waterproof sealing between a surface and an elongate member projecting through that surface. The device is particularly suitable for sealing about vent pipes, and other pipes and conduits, projecting through an outer surface of a tiled or metal deck clad roof, and it will be convenient to hereinafter describe the invention in relation to that exemplary application. It is to be appreciated, however, that the seal device is not limited to that application.

2. The Prior Art

Traditionally, metal flashing has been used to waterproof seal between a roof covering and an elongate member projecting therethrough, although in recent years seal devices have been specifically developed as a substitute. Examples of such seal devices are disclosed in Australia patents 514247 and 568737, as well as Australian design registrations 82275, 90304, 90305, 91270, 91271, 91272, 91723, 97582 and 97740.

Whilst these devices function generally satisfactorily, they are often subject to unacceptably high manufacturing rejection rates, and are generally expensive to manufacture. That is particularly so where, during manufacture, a flexible non-metallic part of the device is molded to a deformable, non-resilient metallic part. The molding apparatus, and in particular the molding die, is required to be of sufficient size to accommodate the metallic part, and sometimes that metallic part is quite large even though the non-metallic part to be molded is relatively small. As such, large and expensive molding apparatus may have to be allocated to relatively small molding tasks in manufacturing the seal device.

In addition, the use of readily deformable metallic parts, such as those composed of lead or aluminium-/aluminium alloy, sometimes causes difficulties by improperly deforming during the molding process under forces applied by the molding die to material being molded into the non-metallic part. This results in a poorly molded part and the entire device usually must be discarded, adding to the cost of device manufacture.

In an effort to alleviate these difficulties it has been proposed that the non-metallic part be separately molded and then subsequently connected to the metallic part. Examples of connections include the use of adhesives and mechanical locking or clamping elements. However, the adhesives may break down or otherwise be unreliable over a period of time, leading to device leakage. The locking or clamping elements can in themselves be expensive as well as "fiddy" to apply. In addition, in an effort to provide the seal device with versatility, completion of the connection is often left to the end user of the device and that requires the user to initially cut a neat hole at a desired location in the metallic part, over which the non-metallic part is then positioned for connection. Cutting that hole can often be difficult to achieve correctly, with errors leading to wastage of metallic part material or potential leakage of the device during use.

A further seal device arrangement has involved separate molding of the non-metallic part and separate manufacture of a rigid base part on which the non-metallic part is then fitted. The base part has an upstanding boss whilst the non-metallic part has a skirt which overlies the boss for securing thereto. The skirt may be secured by means of a peripherally extending clamp element, or the boss and skirt may be provided with peripherally extending ribs and grooves which interlock one another to form a mechanical interconnection. However, that interconnection may be relatively easily broken or disturbed, again leading to potential leakage of the device in use. Moreover, to provide rigidity in the boss, the base part is usually molded of concrete, terracotta or rigid plastic material into a final shape, such as a roofing tile or shingle, so that its use is somewhat limited to the molded shape.

BRIEF DESCRIPTION OF THE PRESENT INVENTION

It is an object of the present invention to alleviate these difficulties and disadvantages in prior seal devices through the provision of a relatively simple alternative seal device.

With this object in mind, the present invention provides a seal device for sealing between a surface and an elongate member projecting through that surface, including: a mounting plate having a generally planar base portion with opposed inner and outer faces and an access aperture therethrough, the mounting plate being composed of metallic, non-resilient, manually deformable material, and in use being located with the inner face in a face-to-face relation with a surface so that an elongate member projects through the access aperture, the base portion being deformable to conform to the contour of the surface and at least substantially retain the deformed contour, the mounting plate also having a rim portion extending about the periphery of the access aperture and upstanding from the outer face of the body portion, the rim portion having a retaining lip spaced outwardly of the base portion and shaped to provide an underlying shoulder; and, a sealing member which, in use of the device, overlies the access aperture and outstands from the outer face of the body portion, the sealing member having an access passage for receiving the elongate member therein with the sealing member sealingly engaging the elongate member, and the sealing member having a skirt portion for overlying the rim portion with at least one retaining projection extending beneath the retaining lip for engaging against the shoulder and thereby connecting the sealing member to the mounting plate.

This invention is described with reference to the seal device installed on an outer surface of a roof having an elongate member projecting vertically therethrough, and terms such as "upstanding" should be construed in the light of this orientation. It is to be appreciated, however, that other orientations may be equally possible and that consequential changes in terms such as that above may be necessary in the light of those other orientations for a proper understanding of the invention.

In a preferred embodiment, the rim portion includes a flange upstanding about the periphery of the access. The retaining lip projects generally laterally from the flange so as to form the underlying shoulder.

The retaining lip projects laterally outwardly of the flange away from the access aperture.

The flange upstands perpendicular from the base portion and extends continuously about the periphery of the access aperture, the retaining lip preferably is continuous about this flange.

The retaining lip has an inverted U cross sectional shape. This shaped lip defines a downwardly opening retaining groove into which the retaining projection extends for connecting the sealing member to the mounting The retaining projection projects inwardly of the skirt portion. Moreover, the projection includes a retaining rib extending continuously within the skirt portion in one embodiment, that retaining rib engaging the underlying shoulder for connecting the sealing member to the mounting plate. In one embodiment the retaining rib outstands from the skirt portion and upstands for engagement in the retaining groove.

The sealing member skirt portion has a lower sealing edge. When the retaining projection engages the underlying shoulder, this edge sealingly engages the upper face of the base portion. The lower edge extends continuously about the access passage and is tapered to a terminal flexible sealing lip which presses against the upper face continuously about the rim portion.

The following description refers to a preferred embodiment of the seal device of the present invention. To facilitate an understanding of the invention, reference is made in the description to the accompanying drawings where the seal device is illustrated in that preferred embodiment. It is to be understood that the seal device is not limited to the preferred embodiment as hereinafter described and as illustrated in the drawings.

DETAILED DESCRIPTION OF THE PREFERRED EMBODIMENT

Figure 1:
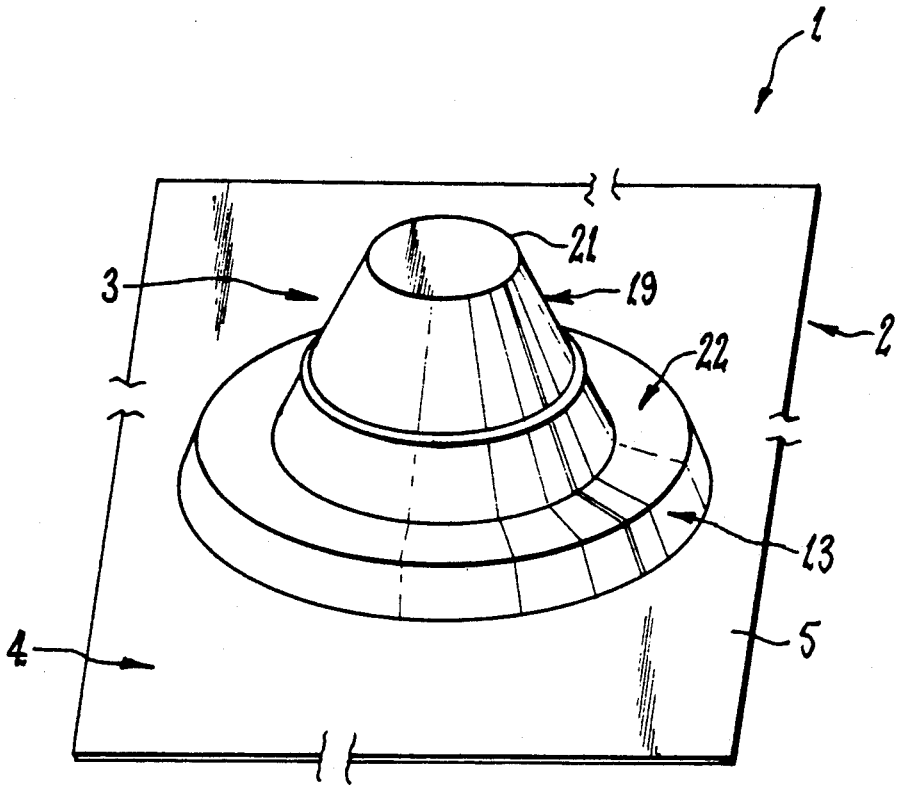
FIG. 1 is a perspective view of one preferred embodiment of the seal device of the present invention.

Referring initially to FIG. 1 there is generally shown seal device 1 including mounting plate 2 and sealing member 3 upstanding from and connected to plate 2.

Figure 2:
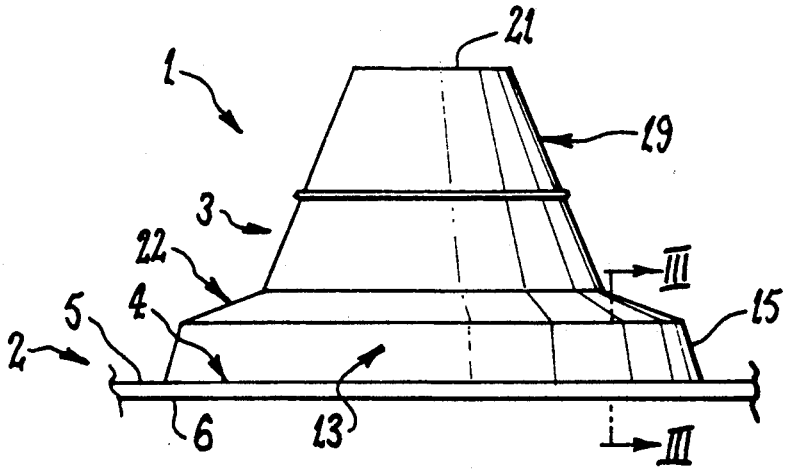
FIG. 2 is a side elevational view of the seal device of FIG. 1.
Figure 4:
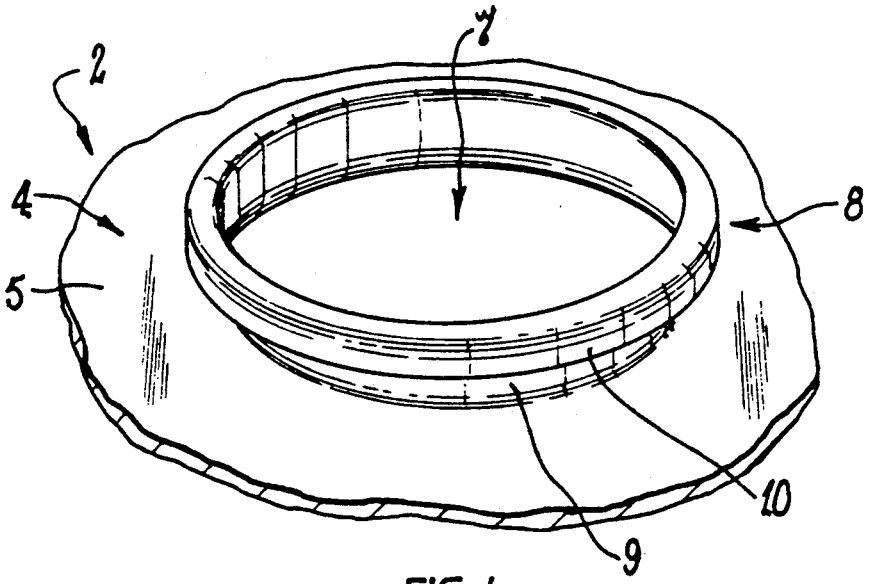

Mounting plate 2, shown in more detail in FIGS. 2 and 4, is of one piece construction, although in another embodiment (not shown) it may be constructed in more than one piece. That construction may depend on the materials of construction and ease with which the materials can be formed into plate 2. Mounting plate 2 is composed of any material suitable to the proposed application of device 1. That material is lead in one embodiment, whilst in another embodiment is aluminium or aluminium alloy.

Mounting plate 2 has planar base portion 4 with upper and lower faces 5, 6. Portion 4 is of any shape and size suitable to the proposed application of device 1. Plate 2 is generally quadrangular shape in one embodiment (as shown), although is round in another embodiment (not shown). Base portion 4 is of a size selected to overlie and cover an opening in a surface through which an elongate member extends. Thus, in one embodiment base portion 4 is square shaped and at least large enough to overlap an opening created by a removed roof tile or shingle.

Base portion 4 contains access aperture 7 of any shape and size suitable to the proposed application of device 1. In one embodiment (as shown) aperture 7 is circular, although is multisided in another embodiment (not shown). Aperture 7 is sized to freely receive an elongate member therethrough. Moreover, aperture 7 is centrally located in base portion 4 in one embodiment, and offset in another embodiment to provide increased versatility in accommodating various elongate member locations relative to the opening in the surface.

Mounting plate 2 also has rim portion 8 defining the periphery of access aperture 7. Rim portion 8 has flange 9 upstanding from base portion 4 and merging into retaining lip 10. Flange 9 upstands perpendicular to base portion 4 in one embodiment (as shown), although in another embodiment (not shown) flange 9 is otherwise upwardly angled relative to base portion 4. In one embodiment flange 9 upstands between about 10 to 20 mm, and in one specific embodiment stands about 15 mm above the base portion 4.

Retaining lip 10 extends continuously or endlessly about the flange 9. Moreover, lip 10 projects laterally of flange 9 so as to form underlying shoulder 11, that projection being radially outwardly away from aperture 7 in one embodiment (as shown), and radially inwardly over aperture 7 in another embodiment (not shown). For simplicity, shoulder 11 is provided by an underneath face of retaining lip 10.

Lip 10 extends straight away from flange 9 in one embodiment (not shown). However, in another embodiment (as shown) lip 10 extends away from flange 9 and then downwardly so as to define underlying, downwardly opening retaining groove 12. Lip 10 extends downwardly up to about half of the height of flange 9, in one embodiment, and in another particular embodiment extends downwardly about one third that height. Lip 10 is rolled or turned away from flange 9.

Figure 3:
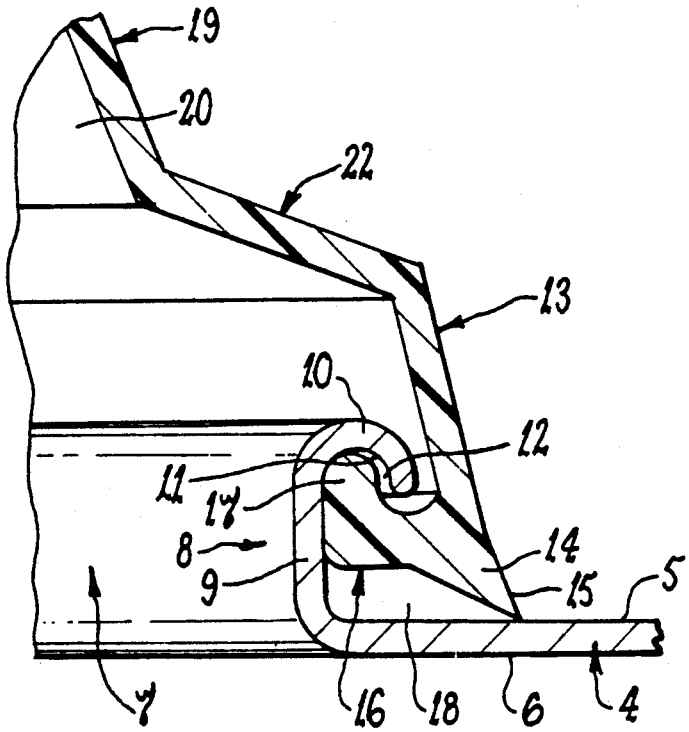
FIG. 3 is an elevational fragmentary sectional view of the seal device taken through section III—III of FIG. 2; and, FIG. 4 is a fragmentary perspective view of the mounting plate of the seal device of FIG. 1.

Sealing member 3, shown in detail in FIGS. 2 and 3, is of one piece construction and is molded in one embodiment (as shown). Sealing member 3 is composed of any material suitable to the proposed application of device 1. That material is rubber in one embodiment whilst in another embodiment is plastics material.

Sealing member 3 has skirt portion 13 shaped and sized to extend entirely about and fit closely about rim portion 7. Thus, in one embodiment (as shown) skirt portion 13 is circular shape to fit abut circular access aperture 7 and annular flange 9. Skirt portion 13 is spaced apart from rim portion 8 to facilitate deformation of mounting plate 2 and sealing member 3, during seal device use, without destroying or adversely affecting the connection therebetween.

Skirt portion 13 extends downwardly about rim portion 8 to lower edge 14 which sealingly presses against upper face 5. That facilitates waterproof connection between mounting plate 2 and sealing member 3. Lower edge 14 is narrow or feathered or tapered to increase the flexibility of skirt portion 13 at lower edge 14 and thereby enhance engagement with upper face 5, particularly when base portion 4 and/or sealing member 3 is deformed. That lower edge shaping may also inhibit water ingress between lower edge 14 and upper face 5 due to capillary action. In addition, skirt portion 13 diverges generally outwardly as it extends downwardly over rim portion 8 so as to provide a sloped outer face 15 facilitating water or other liquid run off away from sealing member 3.

Sealing member 3 has at least one retaining projection 16 extending inwardly of skirt portion 13 for extending beneath retaining lip 10 and engaging underlying shoulder 11 thereby to connect sealing member 3 to mounting plate 2. In one embodiment (as shown), a single retaining projection 16 is provided, which extends continuously or endlessly about skirt portion 13. It should be appreciated that in another embodiment (not shown) a plurality of retaining projections are provided, those projections being spaced apart about skirt portion 13.

Single retaining projection 16 includes bead or rib 17 of a suitable shape and size having regard to the shape and size of rim portion 8. In that regard, in one embodiment (as shown) retaining projection 16 is hook shaped in cross sectional shape so as to "hook" about and beneath retaining lip 10 for engagement with underlying shoulder 11. In another embodiment (not shown) projection 16 is of a bulbous cross sectional shape to simply fit beneath retaining lip 10. Where retaining groove 12 is formed then retaining projection 16 extends into groove 12 in order to enhance connection between sealing member 3 and mounting plate 2.

Retaining projection 16 is shaped and sized relative to rim portion 8 so as to permanently abut the underneath face of retaining lip 10. This has the advantage of providing a waterproof seal between mounting plate 2 and sealing member 3. Moreover, retaining projection 16 is shaped and sized relative to rim portion 8 so as to permanently abut against flange 9. This also enhances waterproof sealing between plate 2 and member 3. Positive location of sealing member 3 on mounting plate 2 is also facilitated.

However, retaining projection 16 does not engage or contact upper face 5, but rather space 18 is defined therebetween. This inhibits ingress of water and other liquid between upper face 5 and projection 16 through capillary action. Space 18 may also facilitate fitting of sealing member 3.

Sealing member 3 also includes at least one sleeve portion 19 extending upwardly from skirt portion 13 and provides access passage 20 through which an elongate member extends in use of device 1. It is sleeve portion(s) 19 that actually engage the elongate member and waterproof seal thereagainst.

In one embodiment (as shown) a single sleeve portion 19 is provided. That sleeve portion 19 is located centrally of skirt portion 13. In another embodiment (not shown), a plurality of sleeve portions 19, such as four, are provided, those sleeve portions upstanding in spaced apart relation from skirt portion 13. This plurality of sleeve portions 19 has the advantage of enabling several elongate members to extend through the one access aperture 7 and through individual sleeve portions 19.

Sleeve portion(s) 19 are open at terminal end 21 in one embodiment (not shown). This permits immediate fitting of an elongate member through sleeve portion(s) 19. In another embodiment (as shown), terminal end(s) 21 are closed, and opened as necessary by cutting sleeve portion(s) 19. That may be particularly suitable where a plurality of sleeve portions 19 are provided since it allows one or some only of them to be utilized with the remaining sleeve portions 19 being left in reserve.

Sleeve portion(s) 19 connect to skirt portion 13 through connecting wall portion 22. In that regard, sleeve portion(s) 19 merge into wall portion 22 which in turn merges into skirt portion 13. Wall portion 22 slopes outwardly and downwardly from sleeve portion(s) 19 to skirt portion 13 to facilitate water run off from sealing member 3.

Seal device 1 is manufactured by separately making sealing member 3 and mounting plate 2, and then connecting them together. Individually, sealing member 3 and mounting plate 2 can be easily made using standard manufacturing techniques. As such rejection rates can be low. In particular sealing member 3 may be molded in relatively small molding apparatus compared to the apparatus used in the manufacture of previous seal devices. Alternatively, the prior apparatus may be used to mold more than one sealing member 3 simultaneously. In any event, manufacturing costs may be reduced or at least minimized.

The releasable interconnection between sealing member 3 and mounting plate 2 provides seal device 1 with increased versatility by being able to mix and vary sealing members 3 and mounting plates 2 that are used together, i.e. different sealing members 3 may be used with different mounting plates 2 as seal device application demands. In addition, this releasable interconnection enables sealing member 3 and mounting plate 2 to be stored and transported separately which may facilitate stacking, storage and transportation in relatively small packages.

The connection between sealing member 3 and mounting plate 2 positively holds them together, and at least in one embodiment, disconnection is very difficult to achieve without substantial distortion of sealing member 3. As such, accidental or inadvertent disconnection is unlikely to occur.

Finally, it is to be understood that various modifications and/or alterations may be made to the seal device without departing from the ambit of the present invention as defined in the claims appended hereto.

I claim:

1. A seal device for sealing between a surface and an elongate member projecting through that surface, comprising: a one-piece mounting plate having a generally planar base portion with opposed inner and outer faces and an access aperture therethrough, the mounting plate being composed of metallic, non-resilient, manually deformable material, and in use being located with the inner face in a face-to-face relation with a mounting surface so that an elongate member projects through the access aperture, the base portion being deformable to conform to the contour of the surface and at least substantially retain the deformed contour, the mounting plate also having a rim portion integral with the base portion and extending about the periphery of the access aperture, the rim portion upstanding from the outer face of the body portion and having a retaining lip spaced outwardly of the base portion and shaped to provide an underlying shoulder; and, a sealing member which, in use of the device, overlies the access aperture and outstands from the outer face of the body portion, the sealing member having an access passage for receiving the elongate member therein with the sealing member sealingly engaging the elongate member, and the sealing member having a resiliently flexible skirt portion for overlying the rim portion with at least one retaining projection extending beneath the retaining lip for sealingly engaging against the rim portion and thereby releasably connecting the sealing member to the mounting plate, the skirt portion being shaped and sized relative to the rim portion and the spacing of the retaining projection from the base portion so that, by resiliently distorting the skirt portion, the retaining projection can be fitted beneath and released from beneath the retaining lip to respectively, achieve connection and disconnection between the sealing member and the one-piece mounting plate.

2. A seal device as claimed in claim 1, wherein the rim portion includes a flange upstanding about the periphery of the access aperture and the retaining lip projects laterally from the flange so as to form the underlying shoulder.

3. A seal device as claimed in claim 1, wherein the retaining lip projects laterally outwardly of the flange away from the access aperture.

4. A seal device as claimed in claim 3, wherein the flange perpendicular from the inner and outer faces the base portion and extends continuously about the periphery of the access aperture, and the retaining lip extends continuously about the flange.

5. A seal device as claimed in claim 1, wherein the retaining lip has an inverted U cross sectional shape thereby defining a downwardly opening retaining groove into which the retaining projection extends for connecting the sealing member to the mounting plate.

6. A seal device as claimed in claim 5 wherein the retaining projection projects radially inwardly of the skirt portion and includes a retaining rib extending continuously within the skirt portion, the retaining rib engaging the underlying shoulder for connecting the sealing member to the mounting plate.

7. A seal device as claimed in claim 6, wherein the retaining rib is spaced radially inwardly of the skirt portion and for engagement in the retaining groove.

8. A seal device as claimed in claim 1, wherein the sealing member skirt portion has a lower sealing edge which, when the retaining projection engages the underlying shoulder, sealingly engages the upper face of the base portion.

9. A seal device as claimed in claim 8, wherein the lower sealing edge extends continuously about the access passage and is tapered to a terminal flexible sealing lip which presses against the upper face continuously about the rim portion.

10. A seal device as claimed in claim 1, wherein when the retaining projection engages the underlying shoulder, the retaining projection is spaced from the upper face of the base portion so as to define a space therebetween which inhibits liquid ingress between the rim portion and retaining projection through capilliary action.

* * * * *